US006578240B2

(12) United States Patent
Fortenberry

(10) Patent No.: US 6,578,240 B2
(45) Date of Patent: Jun. 17, 2003

(54) PAPER BINDING FASTENER

(76) Inventor: John Fortenberry, 12 W. 76th St., No. 5F, New York, NY (US) 10023

( * ) Notice: Subject to any disclaimer, the term of this patent is extended or adjusted under 35 U.S.C. 154(b) by 0 days.

(21) Appl. No.: 09/990,696

(22) Filed: Nov. 9, 2001

(65) Prior Publication Data

US 2003/0088951 A1 May 15, 2003

(51) Int. Cl.[7] ..... B42F 13/34
(52) U.S. Cl. ..... 24/67 R; 24/453
(58) Field of Search ..... 402/60, 64, 63, 402/67; 411/508–510, 512; 24/297, 453, 110, 635, 67 R, 67.1; 281/21.1

(56) References Cited

U.S. PATENT DOCUMENTS

| | | | | |
|---|---|---|---|---|
| 283,653 A | | 8/1883 | Paxson | |
| 915,925 A | | 3/1909 | Albrecht | |
| 1,138,619 A | | 5/1915 | Betts | |
| 2,583,224 A | | 1/1952 | McDonald | |
| 2,797,605 A | | 7/1957 | Metze, Jr. et al. | |
| 3,251,260 A | | 5/1966 | Serdechny | |
| 3,288,143 A | * | 11/1966 | Federbush et al. | 402/64 |
| 3,569,903 A | * | 3/1971 | Brishka | 439/352 |
| 3,647,306 A | | 3/1972 | Chamberlin | |
| 4,175,880 A | | 11/1979 | Muller | |
| 4,674,905 A | * | 6/1987 | Masters et al. | 210/646 |
| 4,730,972 A | | 3/1988 | Sun et al. | |
| 4,874,186 A | | 10/1989 | Groswith, III et al. | |
| 4,997,208 A | | 3/1991 | Staats, III | |
| 5,690,443 A | | 11/1997 | Sullivan | |

FOREIGN PATENT DOCUMENTS

| | | | | |
|---|---|---|---|---|
| JP | 11048673 A | * | 2/1999 | B42F/13/30 |

* cited by examiner

*Primary Examiner*—James R. Brittain
(74) *Attorney, Agent, or Firm*—Weiner & Burt, P.C.; Irving M. Weiner; Pamela S. Burt

(57) ABSTRACT

A paper binding fastener having two members which are secured together with ratchet-like catch teeth and which can be released by a component carried on one of the fastener members. The invention preferably provides a male member and a female member each having catch members which are moveable radially so as to engage and disengage the catch members and with at least one of the male and female members carrying an axially displaceable member which when axially moved as manipulated by a user urges the catch members radially to release the catch members from engagement and thus permit separation of the male and female members.

9 Claims, 8 Drawing Sheets

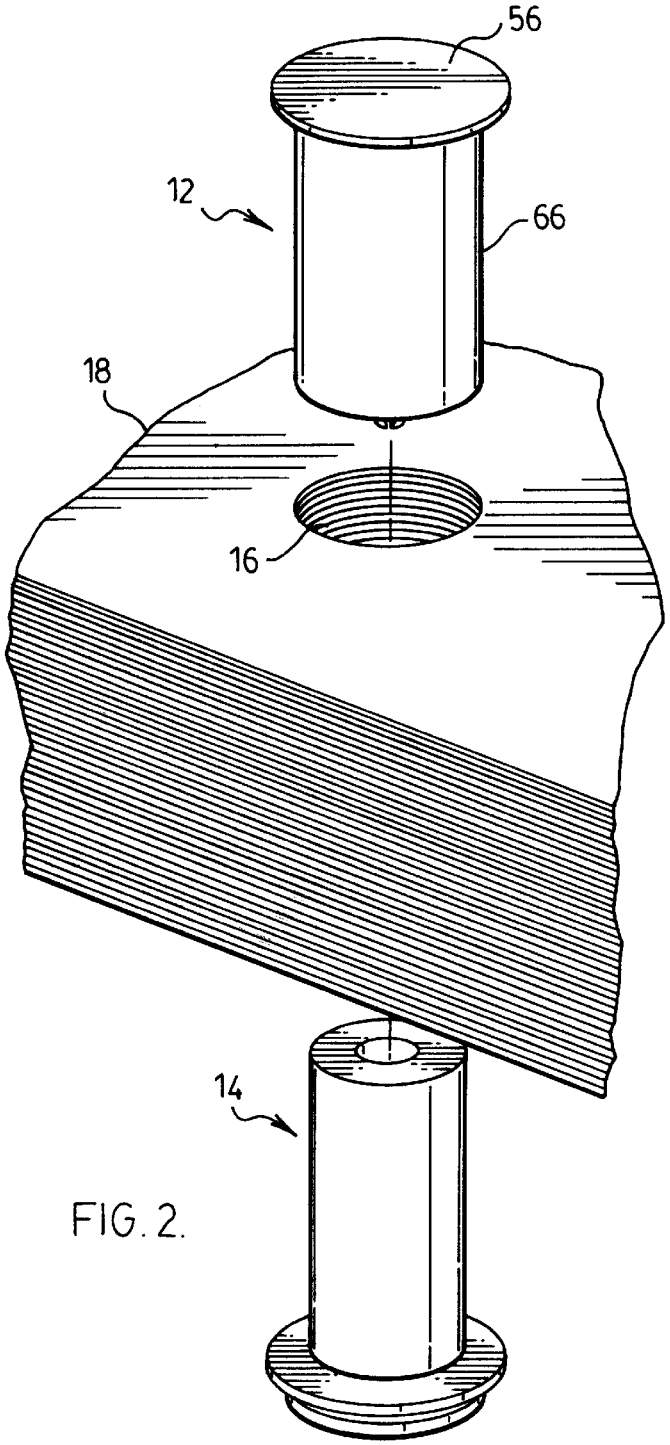
FIG. 2.
FIG. 1.
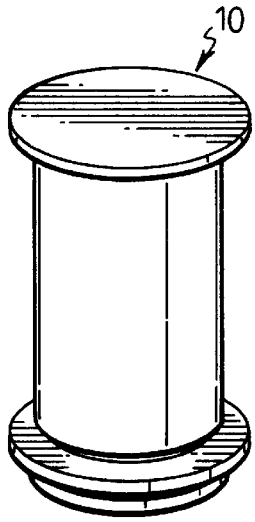

PAPER BINDING FASTENER

SCOPE OF THE INVENTION

The present invention relates to a paper binding fastener and in particular to a paper binding fastener having two parts which can easily be disengaged and released.

BACKGROUND OF THE INVENTION

It is known to bind paper sheets having holes punched therein by placing the sheets in a stack with their holes aligned and placing a binding device through the holes. Known binding devices include threaded fasteners with a male member and a female member inserted into the hole from opposite sides of the stack and rotated relative to each other to bind the sheets together. Such devices have the disadvantage that the threaded members must be rotated relative to each other a number of times for attachment and removal.

Other known devices are rivet-like members in which the male and female members rather than having threads, have ratchet-like catch teeth such that a catch carrying post extends into a catch socket for latching at different depths into the socket. Paper binding fasteners of this type are taught for example by U.S. Pat. No. 2,797,605 to Metze issued Jul. 2, 1957 and U.S. Pat. No. 3,251,260 to Serdechny issued May 17, 1966. Devices of this type suffer the disadvantage that there is no mechanism to release the two members.

Binding devices using rivet-like members with ratchet-like catch teeth are known which provide for release of the two members by use of a separate tool as taught for example by U.S. Pat. No. 2,583,224 to McDonald and U.S. Pat. No. 283,653 to Paxson. In Paxson, a pair of radially outwardly biased prongs may be drawn inwardly by a separate removable cylindrical key carrying a threaded forward socket. In McDonald, a pencil or other separate tool member is required to be urged to bind a pair of spaced arms apart for disengagement.

A disadvantage of devices as taught by Paxson and McDonald is that a separate tool is required and release of the paper binding fastener is not possible without the tool.

SUMMARY OF THE INVENTION

To at least partially overcome these disadvantages of previously known devices, the present invention provides a sheet binding fastener having two members which are secured together with ratchet-like catch teeth and which can be released by a component carried on one of the fastener members. The invention preferably provides a male member and a female member each having catch members which are moveable radially so as to engage and disengage the catch members and with at least one of the male and female members carrying an axially displaceable member which when axially moved as manipulated by a user urges the catch members radially to release the catch members from engagement and thus permit separation of the male and female members.

An object of the present invention is to provide an improved sheet binding device which can easily be disengaged and released.

Another object is to provide a paper binding device which permits ease of release of paper from a stack of paper.

Another object is to provide a paper binding device which can be made substantially entirely out of plastic as by injection molding.

Another object is to provide an inexpensive paper binding device which can be disengaged and released.

Accordingly, in one aspect, the present invention provides:

a paper binding fastener comprising:

a first member having an elongate cylindrical first tube open at a first end and having a flange extending radially outwardly from the first tube at a second end;

a second member having an elongate second tube open at a first end and having a flange extending radially outwardly from the second tube at a second end;

an interior diameter of the second tube being marginally less than an interior diameter of the first tube such that the first end of the second tube is insertable into the first end of the first tube for coaxial telescopic sliding of the second tube within the first tube;

the first member having a first catch member extending axially within the first tube towards the one end thereof and having a catch shoulder directed away from the one end;

the second member having a second catch member extending axially within the second tube towards the one end thereof and having a catch shoulder directed away from said one end;

on insertion of the second tube into the first tube, the catch shoulders of the first and second catch members moving axially past each other to assume positions with the catch shoulders opposed to each other whereby axially removal of the second tube from the first tube is prevented by engagement of the catch shoulders;

one of the first catch members and second catch members comprising a deflectable catch member being deflectable radially from an inherent position which it inherently assumes to a deflected release position in which the catch shoulders thereof is moved radially sufficiently to avoid engagement with the catch shoulder of the other catch member and permit axially movement of the second tube from the first tube;

the one of the first and second members carrying the deflectable catch member having a release member mounted thereto for axially sliding between an extended position and a retracted position;

a spring biasing the release member towards the extended position;

the release member on movement to the retracted position engaging the deflectable catch member and deflecting it to the release position;

the release member having an outer end adapted for engagement manually at the second end of the one of the first and second member carrying the deflectable catch member.

According to another aspect of the invention, there is provided a paper binding fastener comprising:

(a) an outer tubular member having a flange portion provided at a lower end thereof;

(b) an inner tubular member being disposed radially inwardly of said outer tubular member, said outer and inner tubular members being integrally connected at upper ends thereof forming a casing member having a central bore within said inner tubular member open at an upper end thereof and an annular space between said outer and inner tubular members open at a lower end thereof, said inner tubular member being provided with a plurality of openings disposed circumferentially about said inner tubular member;

(c) a female member having a base and a plurality of circumferentially spaced and upwardly extending arm members provided thereon each arm member having a plurality of catch members, said arm members being inserted into said annular space such that each catch member is adapted to be projecting radially and inwardly through an opening provided on said inner tubular member;

(d) a male member having a head portion, a central shaft portion and an annular skirt portion extending downwardly from said head portion, said shaft portion being provided with complementary catch members adapted to engage with corresponding catch members provided on said female member in an engaged position when said shaft portion is inserted into said central bore within said inner tubular member, whereas said annular skirt portion is adapted to slidably engage with said outer tubular member; and (e) a resilient member being disposed between said flange portion of said outer tubular member and said base of said female member; whereby compression of said resilient member urges said upwardly extending arm members to yield radially outwardly into a disengaged position, thereby allowing said male member to be removed from said female member.

Three preferred embodiments of a sheet binding fastener of the present invention are disclosed, one of which having a generally symmetrical configuration, while the other two having an asymmetrical configuration. All three embodiments show a sheet binding fastener having a male member and a female member each having catch members for easy disengagement by simply compressing a resilient spring member in one single action. This renders the binding fastener of the present invention easy to release without any unscrewing or pinching action. The resilient spring member is preferably having adhesive material on both sides thereof so that it is adhered to and sandwiched between the casing member and the female element thereby forming a single female unit or member. Alternatively, the resilient spring member can be provided integrally on the casing member or the female element.

The sheet binding fastener may be used to bind various sheet materials including paper, paperboard, Mylar, textile, fabric and plastic sheets and the like. One preferred use is as a paper binding fastener.

BRIEF DESCRIPTION OF THE DRAWINGS

Further aspects and advantages of the present invention will become apparent from the following description taken together with the accompanying drawings in which:

FIG. 1 is a perspective view of a paper binding fastener in accordance with a first embodiment of the present invention;

FIG. 2 is a perspective view of the two fastening members of the paper binding fastener of FIG. 1 in a separated position ready to be engaged with each other in order to hold a stack of paper;

DETAILED DESCRIPTION OF THE DRAWINGS

Figure 3:
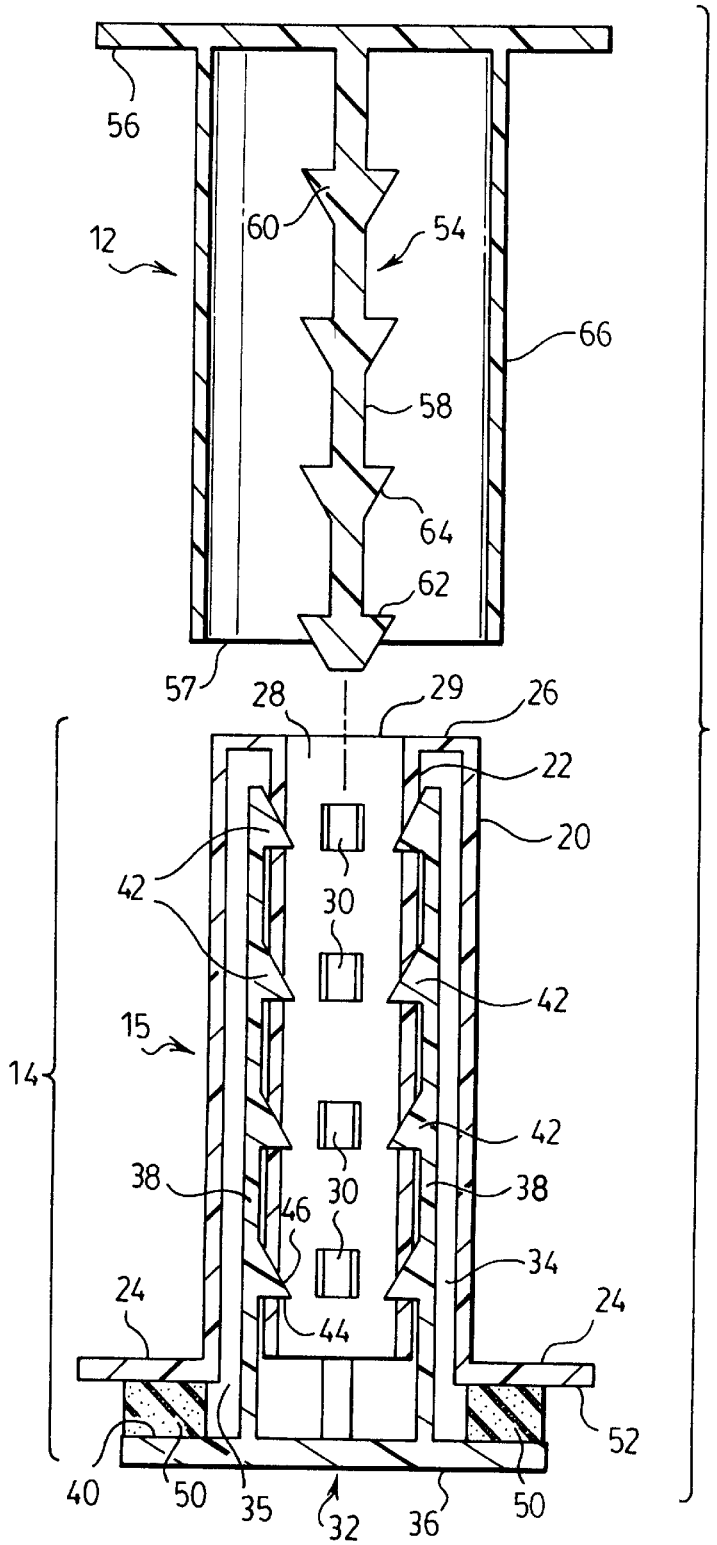
FIG. 3 is a cross sectional partially exploded view of the two fastening members of the paper binding fastener of FIG. 1.
Figure 4:
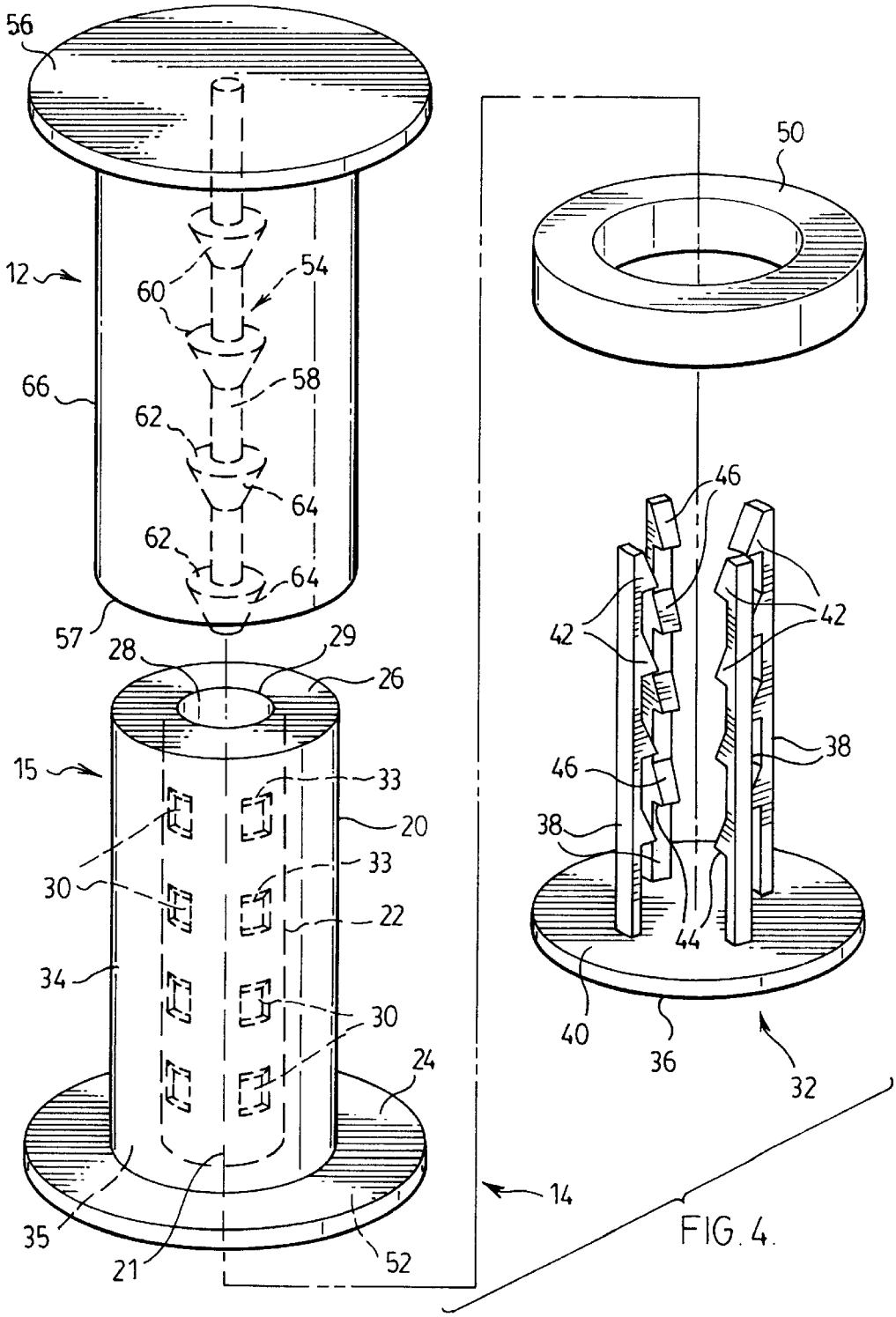
FIG. 4 is an exploded view of the paper binding fastener of FIG. 1.

Referring now in more detail to the drawings, in which like reference numerals represent like parts throughout the several views, FIG. 1 shows a paper binding fastener designated generally by reference numeral 10. The paper binding fastener 10 is adapted to be separable into two fastening members a male member 12 and a female member 14 as shown in FIG. 2.

It is understood that the outer diameter of a tubular body 66 of the male member 12 is slightly less than the diameters of the openings 16 of the stack of paper 18. This allows the male member 12, when engaged with the fastening member 14, to hold the stack of paper 18 in a proper and secured position.

FIG. 3 is a cross-sectional view showing the male member 12 and the female member 14. The female member 14 comprises an assembly of a double tube casing member 15, an annular resilient spring washer 50 and a female element 32.

The male member 12 has an elongate cylindrical hollow tubular member 66 with a radially extending flange or head 56 at one end extending radially outwardly beyond the tubular member 66. The tubular member 66 is closed by the head 56 at one end and open at the other open end 57.

A male element 54 extends from the head 56 coaxially within the tubular member 66 towards the open end 57. The male element 54 has a central shaft 58 carrying four catch members 60 spaced equally along the length of the shaft 58. Each catch member 60 has a conical or frusto conical shape having a cam surface 64 and a catch shoulder 62. The cam surface 64 is directed towards the open end 57 but tapering away from the open end 57 and radially outwardly. The catch shoulder 62 is directed away from the open end 57.

Referring now to the assembly comprising the female member 14, the double tubed casing member 15 has a cylindrical outer tubular member 20 and a cylindrical inner tubular member 22 joined at one end by a radially extending annular bridge flange 26 so that the inner and outer tubular members 20 and 22 are coaxially disposed relative to each other about a central axis 21 and define an annular space 34 therebetween. The annular space 34 is closed at one inner end by the bridge flange 26 and is open at the other open outer end 35.

An annular flange 24 extends radially outwardly from the outer tubular member 20 about the outer end 35 of the space 34. The inner tubular member 22 provides a central bore 28 into the casing member 15 open at an inner opening 29.

Four sets of rectangular openings 30 are provided extending through the wall of the inner tubular member 22 from the space 34 radially into the central bore 28. Each set of openings 30 is shown as having four openings 30 equally spaced axially along the length of the inner tubular member 22 from each other at the same circumferential location. The identical sets of four openings 30 are shown with each set centered 90° from adjacent sets and each respective opening in each set being at the same axial location as a corresponding opening in the other sets.

Each opening 30 is defined within the wall of the inner tubular member 22. About each opening 30, axially inwardly thereof, the wall of the inner tubular member 22 is provided as a camming surface 33 which is directed radially outwardly and towards the open outer end 35, that is with the camming surface extending radially outwardly and away from the open outer end 35.

Female element 32 has a radially extending flange or base portion 36 with an inner surface 40 from which four arms 38 extend at circumferentially spaced locations. Each arm 38 carries four catch members 42 equally spaced along the axially length of the arm 38. Each catch member 42 has a cam surface 46 and a catch shoulder 44. The cam surface 46 is directed away from the flange 40 and radially inwardly towards the central axis 21. The female element 32 is adapted to be coupled to the casing member 15 by being received with the arms 38 extending upwardly through the outer open end 35 of the space 34. As seen in FIG. 3, the female element 32 is received in casing member 15 in a relative position rotated about the cantral axis 21 such that each arm 38 overlies a respective set of openings 30 and with one catch member 42 received in each of the openings 30 so that the catch members 42 extend radially inwardly through the inner tubular member 22 to protrude into the central bore 28 in a relative position of the catch members 42 and the openings 30 referred to as a latching position.

As seen in FIG. 3, the spring washer 50 is disposed about the arms 38 of the female element 32 sandwiched between the flange 36 of the female element 32 and the flange 24 of the casing member 15.

The spring washer 50 is resilient, axially compressible and inherently biased to assume an axial length as shown in FIG. 3. The washer 50 is chosen of an axially size, having regard to the relative axial location of the catch members 42 on the arms 38 and the opening 30 in the inner tubular member 22 that the washer 50 locates catch shoulders 44 of the catch members 40 engaged with an outer wall of.the openings 30 in a latching position as is shown in FIG. 3 and FIG. 5.

Figure 6:
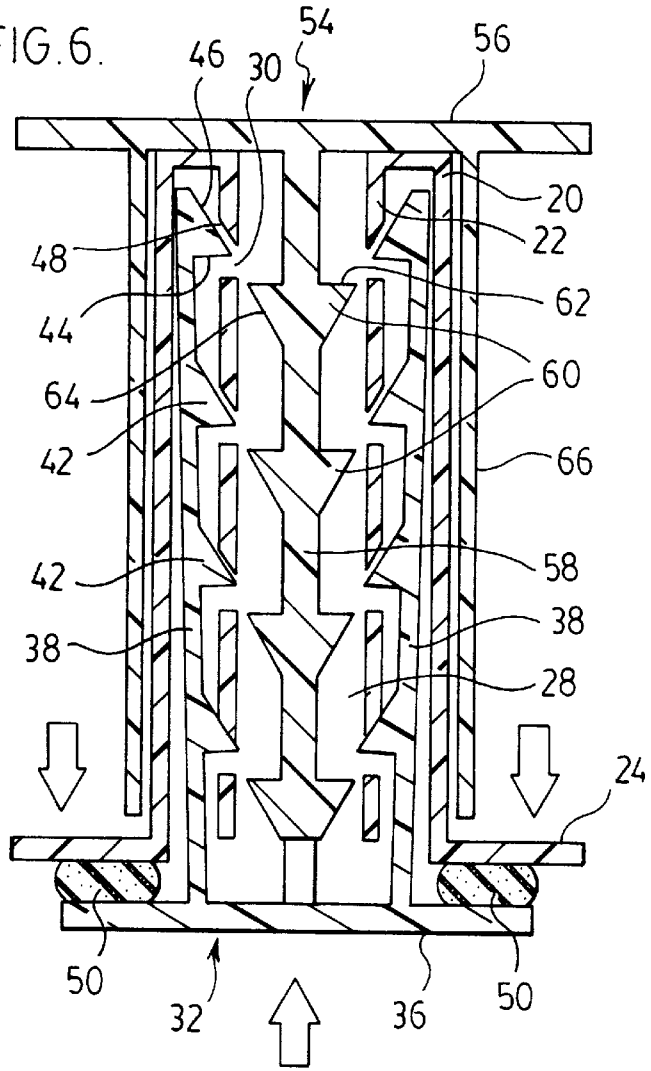
FIG. 6 is a longitudinal sectional view of the paper binding fastener, similar to FIG. 5 in an unlatched configuration.
Figure 5:
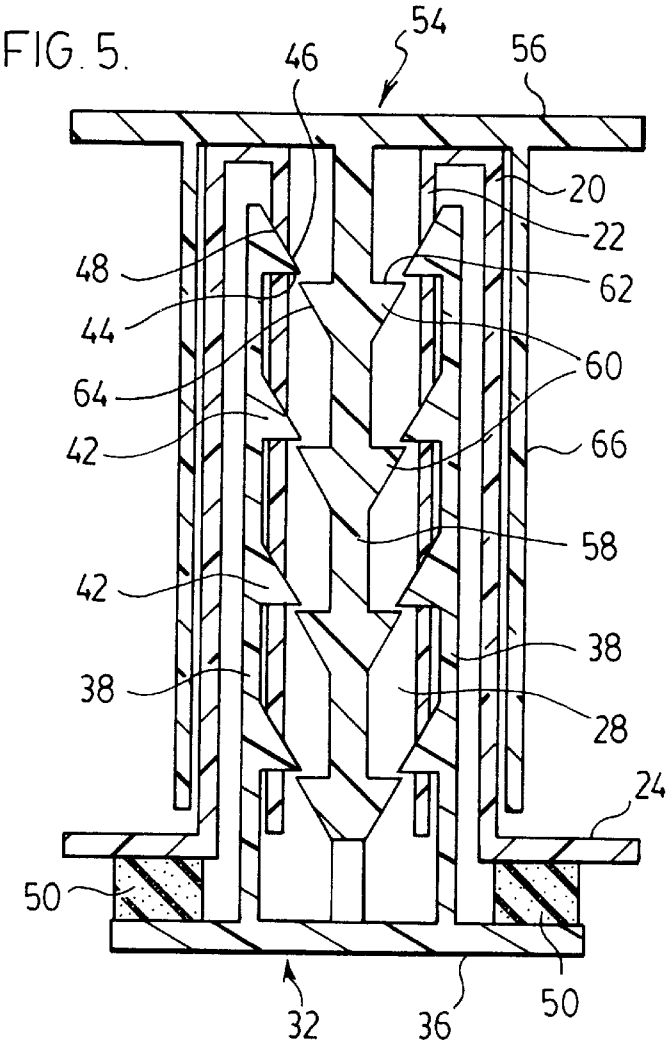
FIG. 5 is a longitudinal sectional view of the paper binding fastener of FIG. 1 in a latched configuration.

The casing member 15 and female element 32 are coaxially moveable between a latching position as seen in FIG. 3 and FIG. 5 and an unlatching position as seen in FIG. 6. The spring washer 50 biases the casing 15 and female element 32 to the latching position. Movement of the casing member 15 and female element 32 to the unlatching position is accomplished by a user manually grasping flange 24 and flange 36 and urging them axially together to compress the spring washer 50 as seen in FIG. 6. On axial relative inward movement of the female element 32 relative the casing member 15, the camming surface 46 of the catch members 42 on the arms 38 engage the camming surface 33 on the inner tubular member 22 and each arm is urged radially outwardly with its catch members 42 becoming displaced radially outwardly. With sufficient relative axial inward movement of the female element 32 relative the casing member 15, the catch members 42 may be displaced radially outwardly sufficiently that they are effectively withdrawn from the central bore 28 as illustrated in the unlatching position seen in FIG. 6.

On a user ceasing to compress the spring washer 50, the spring washer 50 expands axially and draws the female members 32 axially outwardly from the space 34 with the inherent bias of the arm 38 causing the arms 38 to assume their inherent position with the catch members 42 extending radially into the central bore 28.

Coupling of the male member 12 to the female member 14 is accomplished by locating the male member 12 coaxial to the female member 14 with their inner ends in opposition and forcing them axially together. In this respect, it is to be appreciated that the outer tubular member 20 has an outer diameter marginally smaller than an inner diameter of the tubular member 66 of the male member 12 so that the casing member 15 may slide axially into the open end 57 of the male member 12 with the male element 54 to slide axially into the central bore 28 of the casing member 15. With the female member 14 in a latching position as seen in FIG. 3, on the male element 54 axially sliding into the central bore 28, the camming surfaces 64 of the catch members 66 on the male element 54 engage the camming surfaces 46 on the catch members 42 of each arm 38 and bias the arms 38 radially outwardly to permit the catch member 60 on the male element 54 to move inwardly past the catch member 42 on the arms 38.

With the female member 14 in the latching position as seen in FIG. 3, once any catch member 60 on the male element 16 moves inwardly past a catch member 42 on the arms 32, then the male element 60 cannot be axially removed from the bore 28 by reason of the catch shoulders 44 of the catch members 42 on the arms 38 engaging the catch shoulders 62 of the catch members 60 on the male element 54.

Release of the male member 12 from the female member 14 is accomplished by a user compressing the spring washer 50 to urge the casing member 15 and female element 32 to the unlatched position as seen in FIG. 6 wherein the catch members 42 on the female element 32 are sufficiently radially withdrawn from the bore 28 that their catch shoulders 44 do not engage the catch shoulders 62 of the catch members 60 on the male element 54.

Figure 7:
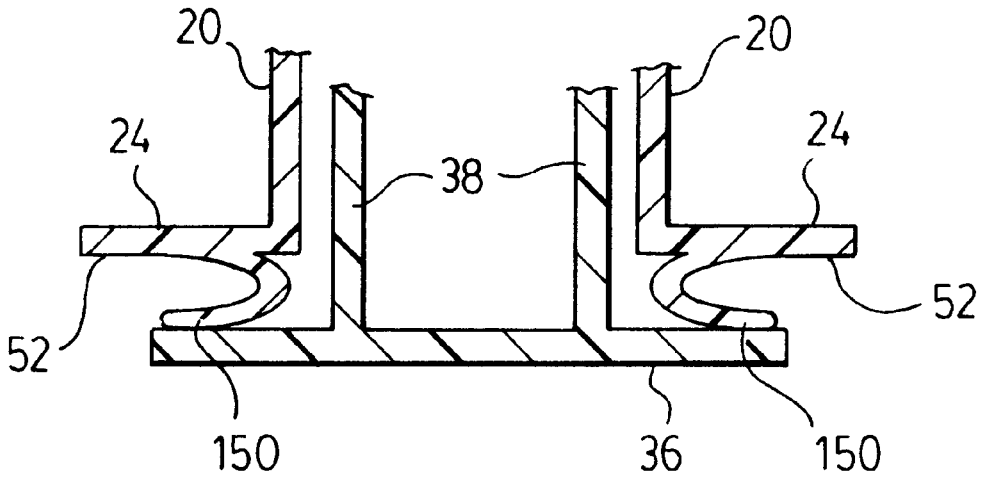
FIG. 7 is a cross sectional view of a second embodiment of a spring member in accordance with the present invention in an uncompressed position.
Figure 8:
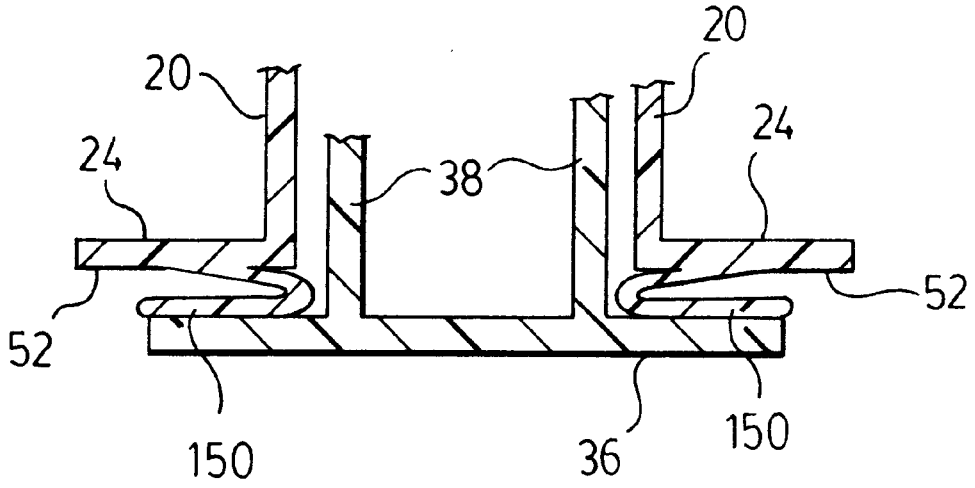
FIG. 8 is a cross sectional view of the second embodiment of FIG. 7, showing the spring member, in a compressed position.

References made to FIG. 7 and FIG. 8 which schematically show a second embodiment similar to that of the first embodiment however differing merely in having the spring washer 50 replaced by a separate spring element 150 which is integrally provided on a lower surface 52 of the flange 24 of the casing member 15. The elastic annular member 150 assumes an inherent unbiased position, as shown in FIG. 7. However it can be axially compressed as shown in FIG. 8 and on release will return to the inherent position shown in FIG. 7. The integrated elastic annular member 150 avoids the need for the spring washer 50 as a separate element.

Figure 9:
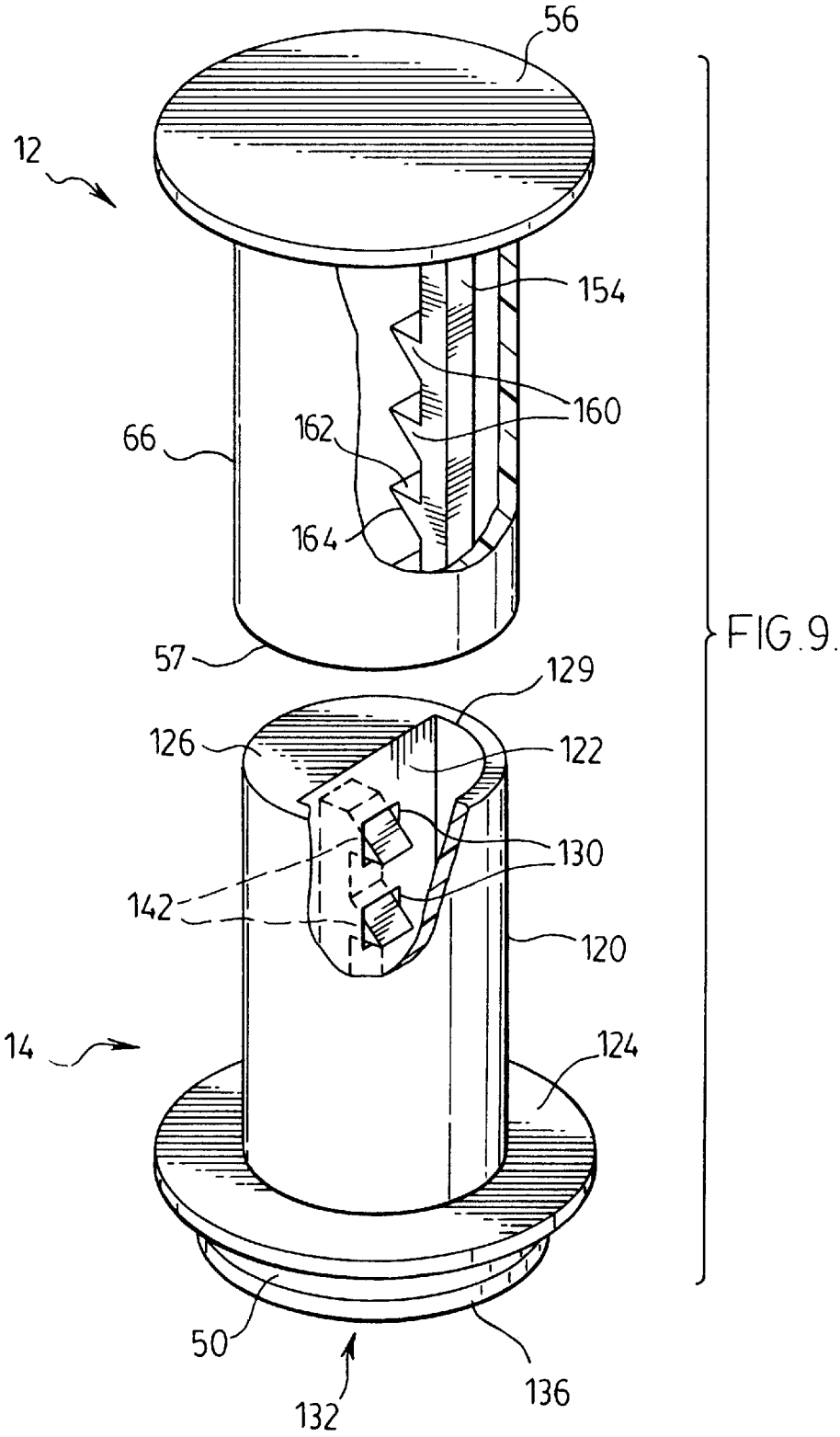
FIG. 9 is a partially cutaway perspective view of a second embodiment of a paper binding fastener in accordance with the present invention.
Figure 10:
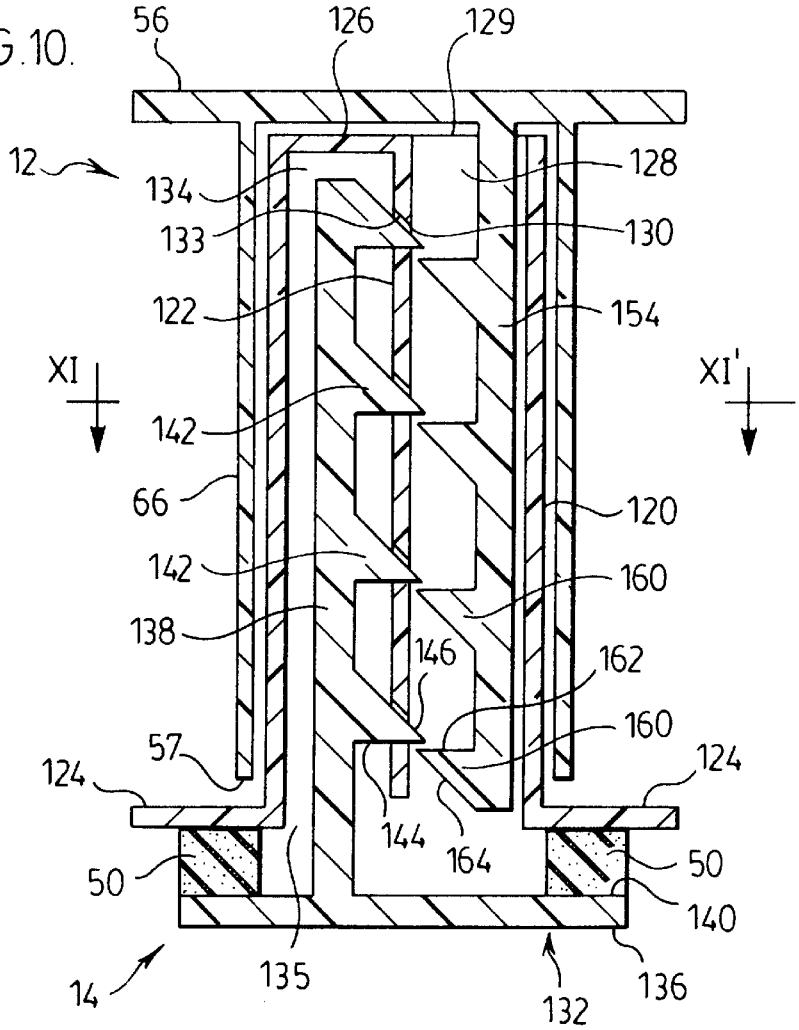
FIG. 10 shows a schematic cross-sectional view of the second embodiment of the binding fastener.
Figure 11:
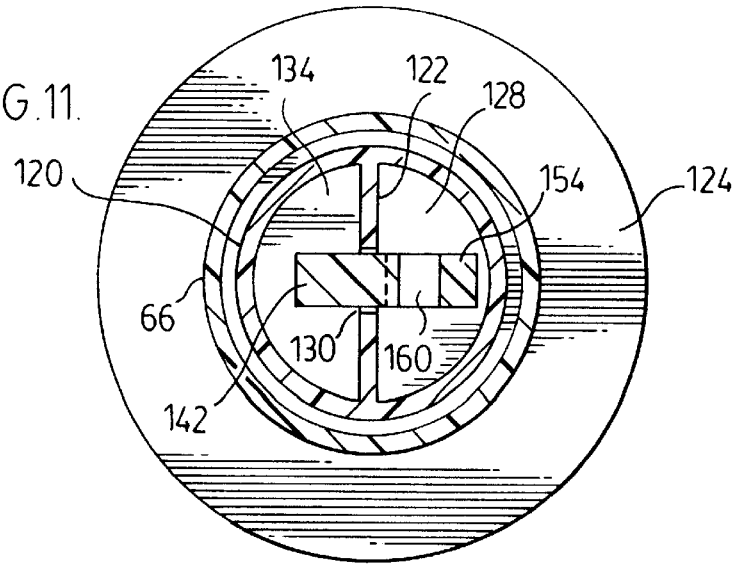
FIG. 11 is a cross-sectional view of the embodiment of FIG. 10 along section line xi–xi' in FIG. 10.

Reference is now made to FIGS. 9, 10 and 11 which show a second embodiment of a paper binding fastener in accordance with the present invention. As illustrated, the male member 12 has an elongated cylindrical hollow tubular member 66 closed by a radially extending flange 56 at one end and open at the other end 57. A male element 154 extends from the head 56 towards the open end 57 near one side of the tubular member 66. According to this embodiment, four catch members 160 are spaced equally along the length of the male element 154. Each catch member 160 has a catch shoulder 162 and a cam surface 164. The catch shoulder 162 is directed away from the open end 57. The cam surface 164 is directed towards the open end 57 but tapering away from the open end 57.

The female member 14 has a cylindrical tubular casing member 120 and a central vertical wall 122 extending within the tubular casing member 120. The central vertical wall 122 divides the tubular casing member 120 into two equal spaces 128 and 134. The space 128 is open at an upper opening 129. The space 134 is closed at an upper end by a semi-circular shaped top plate 126 and is open at a lower end 135.

Four equally spaced rectangular openings 130 are provided extending through the central vertical wall 122 from the space 134 radially into the space 128.

Each opening 130 is defined within the central vertical wall 122. About each opening 130 of the central vertical wall 122 is provided a camming surface 133 which is directed radially outwardly and towards the open lower end 135, that is with the camming surface 133 extending radially outwardly and away from the open lower end 135.

Female element 132 has a radially extending flange or base portion 136 with an inner surface 140 from which an arm 138 extend. The arm 138 is provided with four catch members 142 equally spaced along the length of the arm 138. Each catch member 142 has a catch shoulder 144 and a cam surface 146. The cam surface 146 is directed away from the flange 140 and radially inwardly. The female element 132 is adapted to be coupled to the casing member 120 by being received with the arm 138 extending upwardly through the lower open end 135 of the space 134. As shown in FIG. 10, the female element 132 is received in the space 134 of the casing member 120. Each catch member 142 is received in each of the openings 130 so that the catch members 142 extend radially inwardly through the central vertical wall 122 to protrude into the space 128 in a relative position of the catch members 142 and the openings 130 referred to as a latching position.

As shown in FIG. 10, a spring washer 50 is sandwiched between the flange 136 of the female element 132 and the flange 124 of the casing member 120.

The spring washer 50 biases the female element 132 to the latching position, as depicted in FIG. 10. Movement of the casing member 120 and the female element 132 to the unlatching position is accomplished by a user manually grasping flange 124 and flange 136 and urging them axially together to compress the spring washer 50. On axial relative inward movement of the female element 132 relative the casing member 120, the camming surface 146 of the catch member 142 on the arm 138 engage the camming surface 133 of the opening 130 and the arm 138 is urged radially outwardly with its catch members 142 becoming displaced radially outwardly in an unlatching position thereby allowing the catch member 160 on the male element 154 to be disengaged from the catch member 142 of the female element 132. The male member 12 can therefore be removed from the female member 14, as illustrated in FIG. 9.

Figure 12:
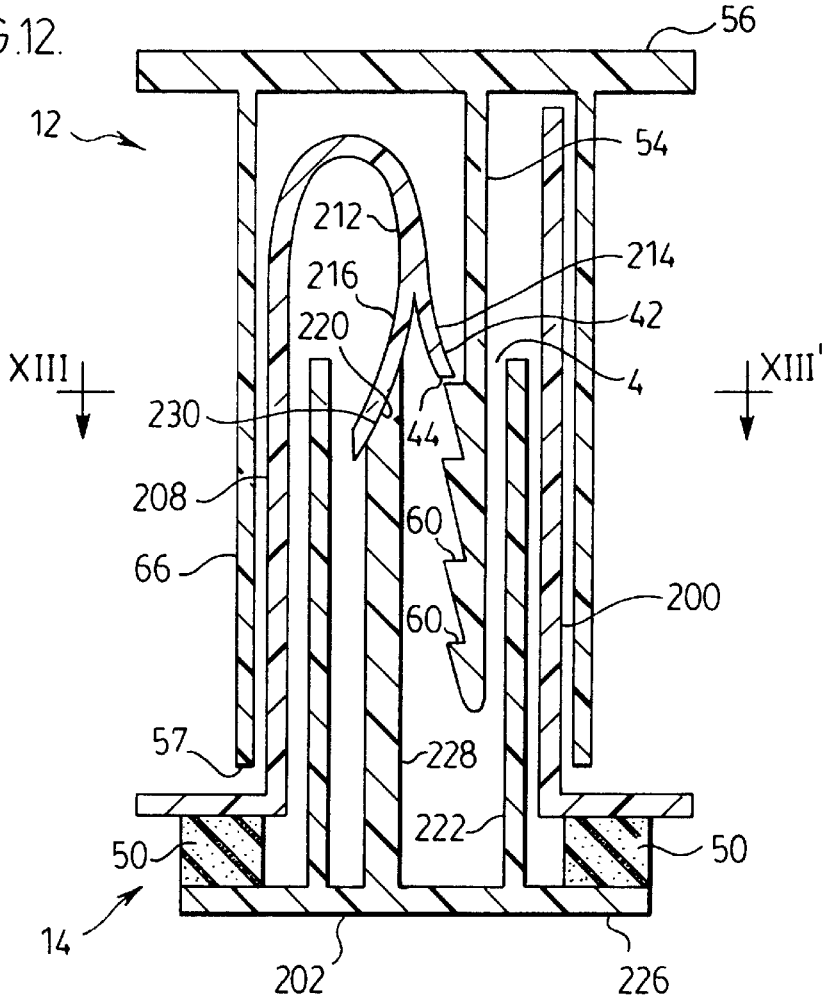
FIG. 12 is a schematic cross-sectional view of a third embodiment of a paper binding fastener in accordance with the present invention.
Figure 13:
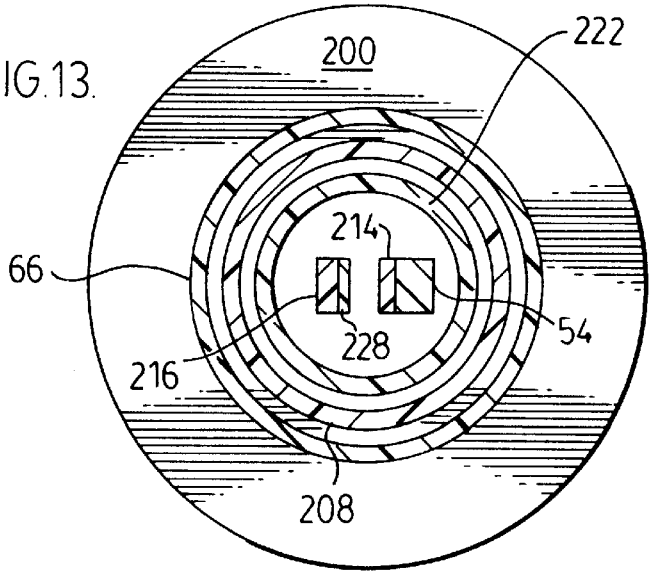
FIG. 13 is a cross-sectional view along section line xiii–xiii' in FIG. 12.

Reference is now made to FIG. 12 and FIG. 13 which show a third embodiment of a paper binding fastener in accordance with the present invention. As shown, the male member 12 has an elongate cylindrical hollow tubular member 66 closed by a radially extending flange 56 at one end and open at the other end 57. A male element 54 extends from the head 56 towards the open end 57 near one side of the tubular member 66. Catch members. 60 are provided on the male element 54.

The female member 14 comprises a female casing member 200, a release member 202 and a spring washer 50. The female casing 200 has a cylindrical tubular member 208 which carries on one side thereof, an elongate arm 212 having an end splitting into a catch arm 214 and a cam arm 216. The catch arm 214 carries a catch member 42 with a cam surface 46 and a catch shoulder 44.

The cam arm portion 216 has a cam surface 220.

The release member 202 has an axially extending tubular member 222 extending axially from a radially extending flange 226.

A cam post 228 extends axially from the flange to provide a cam surface 230 in opposition to the camming surface 220 on the cam arm 216. FIG. 12 shows the fastening member in a latching configuration in which the spring washer 50 biases the release member axially out of the casing member. A user may manually urge the release member 202 into the casing member 200 so as to engage the camming arm 216 with the camming post 228 and place the camming surfaces into engagement and thereby urge the arm 212 including the catch arm portion 214 radially to the left as seen in FIG. 12 so that the catch member 42 on the catch arm 214 become disengaged with the catch members 60 on the male element 58 permitting disengagement and removal of the male member 12 from the female member 14.

Release mechanisms can be provided to prevent the casing member 200 and release member 202 from separating from each other including for example adhering both axial ends of the spring washer 50 to the flanges of the casing member 200 and the release member 202.

Whereas the embodiments shown in FIGS. 1 to 8 comprises a generally symmetrical configuration, the embodiment of FIGS. 9 and 13 shows an asymmetrical configuration having at least one of the male and female members being a single arm having a single catch member. With the three embodiments shown in FIGS. 5, 10 and 12, the male element and the female element can be engaged together to lock the fastener at different axially lengths.

The embodiments shown in FIGS. 5, 10 and 12 may be adapted to be formed as by injection molding from plastic to provide a low-cost element.

While the invention has been described to preferred embodiments, many modifications and variations will now occur to persons skilled in the art. For a definition of the invention, reference is made to the appended claims.

I claim:

1. A sheet binding fastener comprising:

a first member having an elongate cylindrical first tube open at a first end and having a flange extending radially outwardly from the first tube at a second end;

a second member having an elongate second tube open at a first end and having a flange extending radially outwardly from the second tube at a second end;

an interior diameter of the second tube being marginally less than an interior diameter of the first tube such that the first end of the second tube is insertable into the first end of the first tube for coaxial telescopic sliding of the second tube within the first tube;

the first member having a first catch member extending axially within the first tube towards the one end thereof and having a catch shoulder directed away from the one end;

the second member having a second catch member extending axially within the second tube towards the one end thereof and having a catch shoulder directed away from said one end;

on insertion of the second tube into the first tube, the catch shoulders of the first and second catch members moving axially past each other to assume positions with the catch shoulders opposed to each other whereby axially removal of the second tube from the first tube is prevented by engagement of the catch shoulders;

one of the first catch members and second catch members comprising a deflectable catch member being deflectable radially from an inherent position which it inherently assumes to a deflected release position in which the catch shoulders thereof is moved radially sufficiently to avoid engagement with the catch shoulder of the other catch member and permit axially movement of the second tube from the first tube;

the one of the first and second members carrying the deflectable catch member having a release member mounted thereto for axially sliding between an extended position and a retracted position;

a spring biasing the release member towards the extended position;

the release member on movement to the retracted position engaging the deflectable catch member and deflecting it to, the release position;

the release member having an outer end adapted for engagement manually at the second end of the one of the first and second member carrying the deflectable catch member.

2. A fastener as claimed in claim 1 wherein the release member has a release camming surface directed away from its outer end;

the deflectable catch member having a release cam surface directed towards the outer end of the release member;

on movement of the release member towards the retracted position, the release camming surface engages the release cam surface to deflect the deflectable catch member to the release position.

3. A fastener as claimed in claim 1 wherein the first catch member having a first cam surface directed towards the open end of the first tube, the second catch member having a second cam surface directed towards the open end of the second tube;

on insertion of the second tube into the first tube, the first cammed surface engages a second cam surface to deflect the deflectable catch member to the released position.

4. A sheet binding fastener comprising:

(a) an outer tubular member having a flange portion provided at a lower end thereof;

(b) an inner tubular member being disposed radially inwardly of said outer tubular member, said outer and inner tubular members being integrally connected at upper ends thereof forming a casing member having a central bore within said inner tubular member open at an upper end thereof and an annular space between said outer and inner tubular members open at a lower end thereof, said inner tubular member being provided with a plurality of openings disposed circumferentially about said inner tubular member;

(c) a female member having a base and a plurality of circumferentially spaced and upwardly extending arm members provided thereon, each arm member having a plurality of catch members, said arm members being inserted into said annular space such that each catch member is adapted to be projecting radially and inwardly through an opening provided on said inner tubular member;

(d) a male member having a head portion, a central shaft portion and an annular skirt portion extending downwardly from said head portion, said shaft portion being provided with complementary catch members adapted to engage with corresponding catch members provided on said female member in an engaged position when said shaft portion is inserted into said central bore within said inner tubular member, whereas said annular skirt portion is adapted to slidably engage with said outer tubular member; and (e) a resilient member being disposed between said flange portion of said outer tubular member and said base of said female member;

(f) whereby compression of said resilient member urges said upwardly extending arm members to yield radially outwardly into a disengaged position, thereby allowing said male member to be removed from said female member.

5. A sheet binding fastener as claimed in claim 4, wherein each catch member on each arm member has a downwardly facing surface for engagement with a corresponding upwardly facing surface of each catch member on said shaft portion.

6. A sheet binding fastener as claimed in claim 4, wherein each catch member on each arm member has a tapering surface to facilitate slidable movement along a corresponding tapering surface of each opening on said inner tubular member when said arm members are being urged radially outwardly and upwardly as force applies to said resilient member.

7. A sheet binding fastener as claimed in claim 4, wherein each catch member on said shaft portion is provided with a tapering surface to facilitate slidable movement along a corresponding tapering surface of a catch member of said arm member when said male member is being inserted into said female member.

8. A sheet binding fastener as claimed in claim 4, wherein said resilient member is in the form of a foam spring.

9. A sheet binding fastener as claimed in claim 4, wherein said resilient member is in the form of an annular member integrally provided on a lower surface of said flange portion of said outer tubular member, said annular member having a c-shaped cross section.

* * * * *